US005152069A

United States Patent [19]

Lee

[11] Patent Number: 5,152,069

[45] Date of Patent: Oct. 6, 1992

[54] PARALLEL RULE

[76] Inventor: Otis M. Lee, 96, so-ten rd., Kangshan Kaohsiung, Taiwan

[21] Appl. No.: 805,509

[22] Filed: Dec. 13, 1991

Related U.S. Application Data

[63] Continuation-in-part of Ser. No. 595,826, Oct. 10, 1990, abandoned.

[51] Int. Cl.[5] ..... B43L 7/04; B43L 13/02

[52] U.S. Cl. ..... 33/444; 33/449; 33/454

[58] Field of Search ..... 33/449, 454, 443, 444, 33/445, 446, 447, 448, 450

[56] References Cited

U.S. PATENT DOCUMENTS

| | | | |
|---|---|---|---|
| 35,812 | 7/1862 | Dow | 33/449 |
| 2,234,467 | 3/1941 | DeLisle | 33/449 |
| 2,595,842 | 5/1952 | Goerz | 33/449 |
| 3,216,115 | 11/1965 | Simerl | 33/449 |
| 3,225,445 | 12/1965 | Duggan | 33/449 |
| 3,251,131 | 5/1966 | Justis | 33/444 |
| 3,283,410 | 11/1966 | Truhon | 33/444 |
| 3,333,342 | 8/1967 | Meneely | 33/454 |
| 3,455,029 | 7/1969 | Brandys | 33/454 |
| 4,078,312 | 3/1978 | Byers | 33/454 |
| 4,339,881 | 7/1982 | Kapp | 33/444 |
| 4,445,280 | 5/1984 | Hayes | 33/443 |
| 4,688,334 | 8/1987 | Tsou | 33/449 |
| 4,914,824 | 4/1990 | Lee | 33/449 |

FOREIGN PATENT DOCUMENTS

| | | | |
|---|---|---|---|
| 162002 | 1/1949 | Fed. Rep. of Germany | 33/449 |
| 164191 | 10/1949 | Fed. Rep. of Germany | 33/449 |
| 449760 | 6/1949 | Italy | 33/449 |
| 315916 | 10/1956 | Switzerland | 33/449 |
| 342422 | 2/1931 | United Kingdom | 33/454 |

*Primary Examiner*—Thomas B. Will

*Attorney, Agent, or Firm*—Mason, Fenwick & Lawrence

[57] ABSTRACT

A parallel rule which includes a gripper body cover and a rule body, with a gripper body base positioned between them. A plurality of float-contact rollers are installed through respective openings in the rule body and gripper body base. The parallel rule is movable across the paper with only the float-contact rollers contacting the paper, thus minimizing any smearing of drawing ink and the leaving of traces upon the drawing paper. The gripper body cover and an associated end body covers are easily attached and removed from the gripper body base, thus allowing for ease of maintenance.

9 Claims, 2 Drawing Sheets

5
6
9
42
44
4
41
10
22
7
712
713
73
711
71
72
3
2
1
21
411
412
43
81
82
824
821
822
52
54
51
540
53
84
840
833
831
83
832
8
30
60

PARALLEL RULE

This application is a continuation-in-part of U.S. patent application Ser. No. 07/595,826, filed Oct. 10, 1990, now abandoned.

BACKGROUND AND OBJECT OF THE INVENTION

Field of the Invention and Related Art

The present invention relates to a parallel rule, in particular to a parallel rule having an improved rolling device which reduces the thickness of the rule body and facilitates drawing, and having a gripper body that is easily assembled and disassembled.

A conventional parallel rule is formed by aluminum press work, and rollers are riveted at both ends with one thin steel wire is wound around the rollers.

The rollers are exposed to the outside so the wire can easily be disengaged from the rollers even with a very small movement during drawing work. In addition, the ink of the drawing is easily smeared because the entire surface of the rule is in contact surface of the drawing. Although an improved parallel rule as described in U.S. Pat. No. 4,914,824 employs enclosed type rollers, and has a simpler construction, replacement of the wire or other parts is quite difficult if they are broken during operations. Further, installation of the thin steel wire inside the gripper body is still troublesome because the gripper body is integrally formed and does not allow assess to its interior. In another conventional design, a number of coupling seats are necessary to hold the thin steel wire and rollers in position to provide a float-contact means. This complicated means makes assembly and maintenance work quite difficult. Moreover, the rollers make a great deal of noise when the rule body is moved during drawing because the float-contact means requires several rollers connected in series by the thin steel wire, this noise is a large nuisance for a draftsman. Although it is possible to provide a roller type float-contact means at each end of the rule body as supporting means, if the length of the rule body is comparatively long, the center part of the ruler body may sag so as to prevent the parallel rule from moving easily and to cause it to smear the ink of the drawing. Moreover, the sliding motion of the float-contact means and movement of the parallel rule easily becomes uneven.

SUMMARY OF INVENTION

The present invention seeks to mitigate and/or obviate the above-mentioned drawbacks in the manner set forth in the detailed description of the preferred embodiment.

The primary objective of the present invention is to provide a parallel rule having a rolling mechanism which facilitates the movement of the parallel rule, and minimizes the chance that movement of the parallel rule might smear the ink of the drawing or otherwise damage the surface of the drawing. Another objective of the present invention is to allow the gripper body to be easily attached to the rule body during assembly and to be easily disassembled, to allow the steel wire to be quickly and easily installed, inspected and replaced.

Further, another objective of the present invention is to provide a parallel rule in which the thin steel wire will not easily be disengaged from rollers.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF PREFERRED EMBODIMENTS

Figures 1A, 1B:
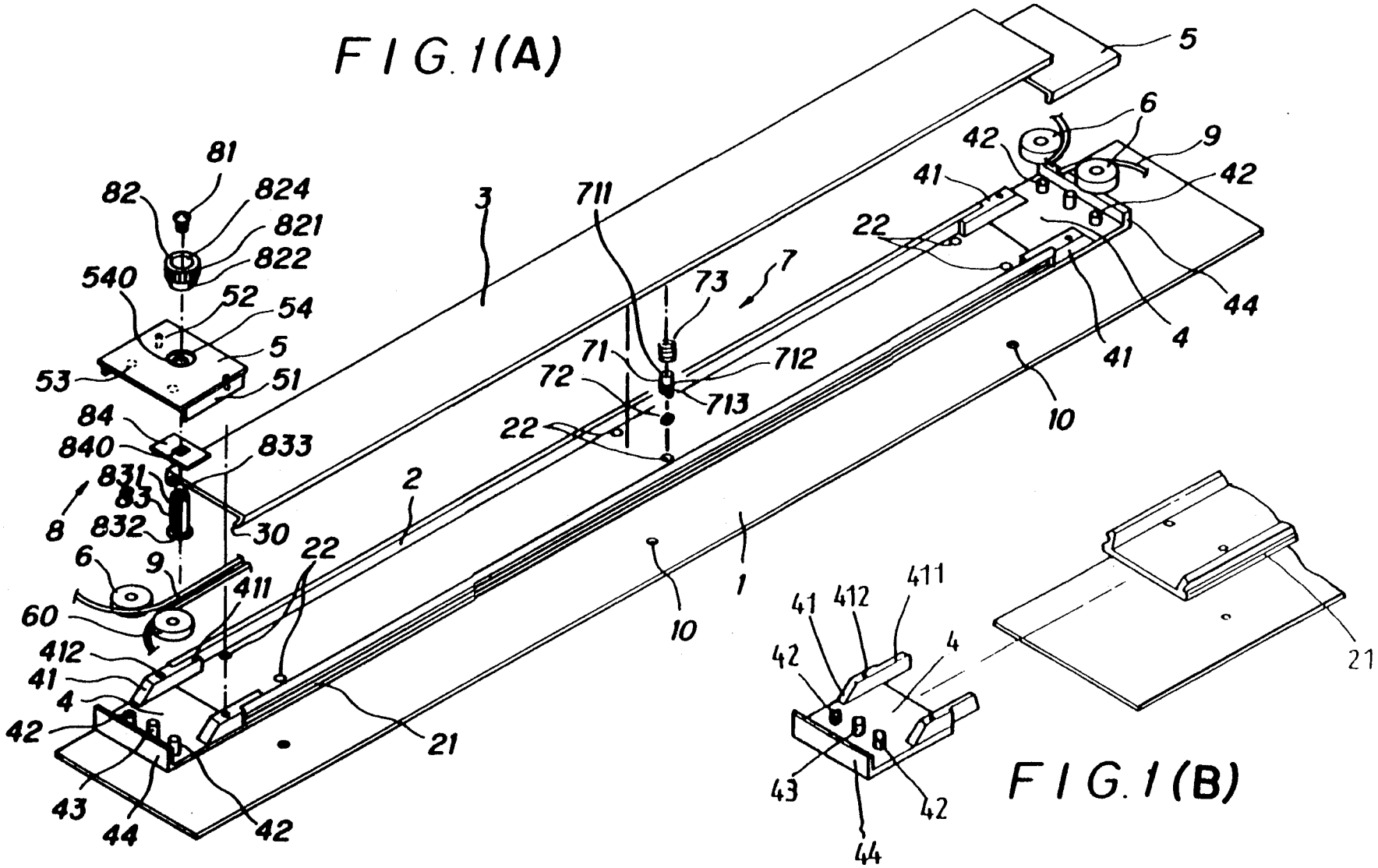
FIG. 1(A) is an exploded view of this invention.
FIG. 1(B) is an enlarged view of parts assembly.
Figure 2:
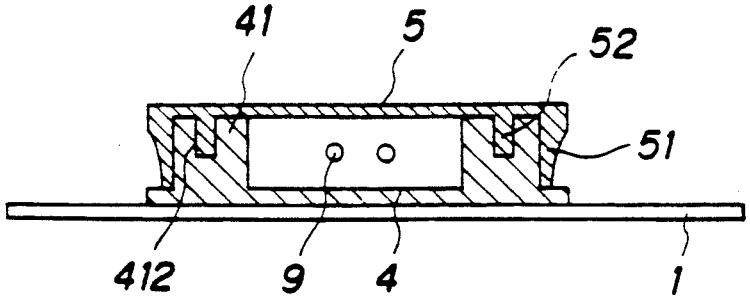
FIG. 2 is a sectional view of the end clamp of this invention.
Figure 3:
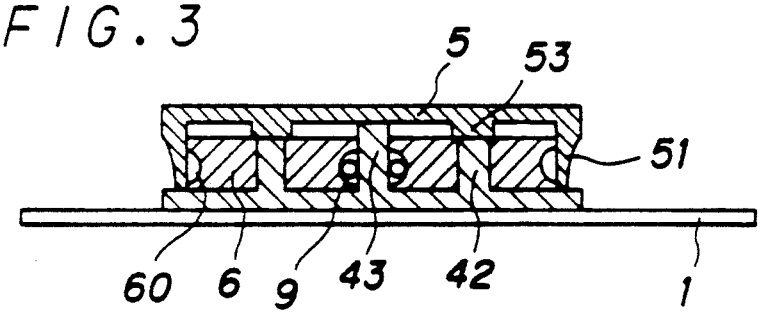
FIG. 3 is a sectional view of the roller of this invention.
Figure 4:
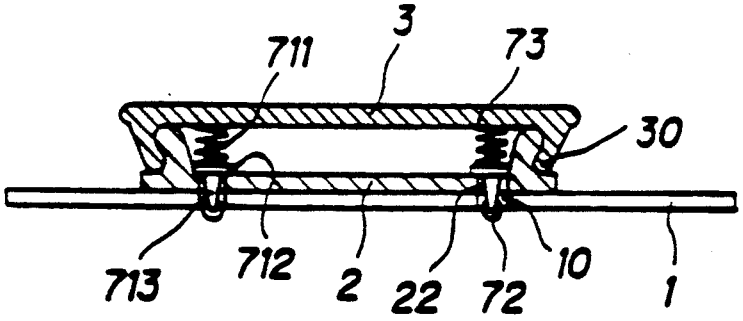
FIG. 4 is a sectional view of the float-contact structure of this invention.

An embodiment of the present invention is described with reference to FIGS. 1 to 5.

The present invention mainly consists of a rule body 1, a gripper body base 2, a gripper body cover 3, end body bases 4, end body covers 5, pulleys 6, float-contact means 7 and a braking mechanism 8.

Rule body 1 is a flat plate, in which six equally spaced opening 10 are provided at convenient positions.

Gripper body base 2 has a width narrower than that of rule body 1, and in each of whose two longitudinal sides thereof is formed a groove 21. After rule body 1 and gripper body base 2 have been assembled, openings 10 are drilled through rule body 1 and gripper body base 2 to house float-contact means 7.

Gripper body cover 3 has the same length as gripper body base 2, with edges 30 integrally formed along its two longitudinal sides in such a manner that edges 30 can be inserted into and fixedly fit into said grooves 21 in the longitudinal sides of gripper body base 2.

End body bases 4 with side blocks 41 and guide blocks 411 integrally formed on both sides thereof, is attached to gripper body base 2 by sliding guide blocks 411 into the space between the longitudinal sides of gripper body base 2. Each side block 41 has a recessed opening 412 on the upper surface thereof. On the opposite end of end body base 4, two pulley posts 42 are provided on which pulleys 6 are pivotally mounted, an intermediate post 43 is provided between roller posts 42. The distance between pulley posts 42, and intermediate post 43 is just sufficient to allow the rotation of pulleys 6. On the outer edge of end body base 4 beyond pulley posts 42 and a intermediate post 43 is integrally formed back plate 44.

End body covers 5 have integrally formed side covers 51 provided along each of its two sides thereof in order to cover the outside of side blocks 41 of end body base 4 and to allow the steel wire to move into and out of the space between gripper body base 2 and gripper body cover 3. Two dowels 52 provided on the bottom side of end body covers 5 fit into recessed openings 412 of side blocks 41 of end body bases 4 and two protrusions 53 also provided on the bottom side of end body cover 5 and opposite dowels 52, press against pully posts 42, in order to thereby keep pulleys 6 in position on pulley posts 42.

In addition to the above mentioned side cover 51, dowels 52 and protrusions 53, one of the two end body covers 5 is also provided in its top side with a shallow recess 54 and an oval opening 540 so that the braking mechanism 8 can be installed therein.

Pulleys 6 have grooves 60 integrally formed around their peripheries to receive thin steel wire 9 therein.

Float-contact means 7 includes three components: molding 71, floating roller 72 and spring 73; spring retainer 711 provided on the upper side of molding 71 retains spring 73 in position; two roller posts 713 are provided on the lower side of molding 71 to retain floating roller 72 in the space formed between roller posts 713; flange 712 with a diameter somewhat greater than that of openings 10 and 22 in rule body 1 and gripper body base 2 is also formed on the lower side of molding 71, so that flange 712 with spring 73 around spring retainer 713 can be constrained by gripper body cover 3 around opening 22 when roller post is placed in said openings 10 and 22 of rule body 1 and gripper body 2.

Figure 5:
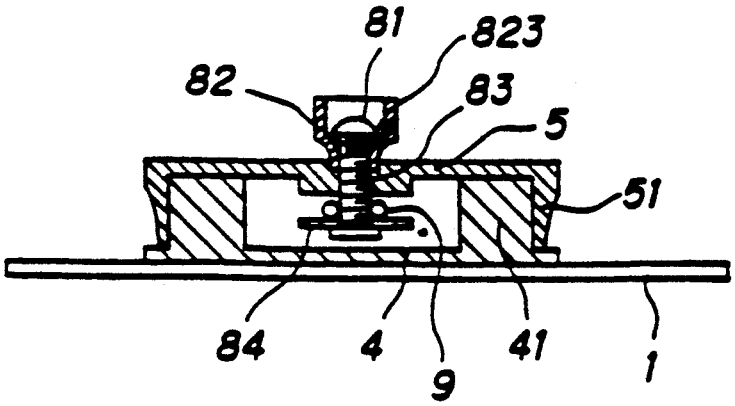
FIG. 5 is a sectional view of the brake mechanism of this invention.

As shown in FIGS. 1(A) and 5, the braking mechanism 8 is a structure in which an adjusting screw 82, secured by a fixing screw 81, is installed onto the oval stem screw 83 which passes through a braking piece 84 and the end cover 5. The adjusting screw 82 has a knurled end 821 on its larger diameter periphery. A smaller positioning end 822 of the adjusting screw can be fit inside a shallow recess 54 of the end cover 5. This positioning end 822 is provided with an internally threaded opening 823 into which the oval stem screw 83 can fit. The knurled end 821 has a round recess 824 for fastening the mounting screw 81 on an upper side of the internally threaded opening 823 (FIG. 5). One end of the oval stem screw 83 has an oval stem 831 having two flat sides. The size of this oval is somewhat smaller than the oval opening 540 of the shallow recess 54 in the end cover 5. The other end of the oval stem screw 83 is larger in diameter and shaped as a flat plate bolt head 832 which actuates the braking piece. The end of the oval stem 831 has a threaded opening 833 into which the mounting screw 81 is screwed to secure the entire braking structure 8. The braking piece 84 is a rectangular plate having a long oval opening 840. The braking piece 84 is actuated by the oval stem screw 83 which fits in the hole 840.

To assemble the parallel rule of this invention, first attach one end body base 4 to each end of gripper body base 2, by inserting guide block 411 of side block 41 of end body base 4 into 2 between the longitudinal sides of gripper body base 2. Then use double-sided adhesive tape to adhere end body bases 4 and gripper body base 2 to rule body 1, before drilling openings 10, 22 through gripper body base 2 and rule body 1, so that openings 22 in gripper body base 2 coincide exactly with openings 10 in rule body 1. Each molding 71 to which floating rullers 72 have already been fitted, can now be inserted into each opening 10, 22, so that flange 712 with spring 73 retained around spring retainers 711 will be held over opening 22. At the same time, a pulley 6 is fitted on each pulley post 42 on end body base 4 and a steel wire 9 is fitted onto grooves 60 installed in a conventional crisscross way.

Finnaly gripper body cover 3 and end body covers 5 are installed so that edges 30 of the gripper body cover 3 are fixedly set in grooves 21 of gripper body base 2 and gripper body cover 3 pushes down on each spring 73 of each float-contact means 7. Dowels 52 of the end body covers 5 fit into recessed openings 412 of each side block 41 of each end body base 4, and protrusions 53 of end body covers 5 press against pulley posts 42 of end body bases 4 to determine the upper and lower positions of pulley rollers 6. The oval stem screw 83 of the braking mechanism 8 is first passed through the braking piece 84 which is placed under the steel wire 9 when installing the end cover 5. The oval stem 831 is put through the oval opening 540 of the shallow recess 54 of the end cover 5. Then the adjusting screw 82 is mounted on the oval stem 83 at the end of which the mounting screw 81 is screwed into the fixing threaded opening 833.

According to the above explanation, the present invention utilizes the following features to achieve the objectives of the invention:

(1) Smooth movement of float-contact:

This design uses floating rollers in a manner which enables the floating rollers to move smoothly without noise when the parallel rule is moved. Because only a limited number of points contact the drawing paper, not only is friction between the table and the floating rollers minimized, but so too are the traces lefting the floating roller upon drawing papers minimized. This is a major feature of this invention.

(2) Simple construction

This invention, in contrast with various conventional designs, is characterized by a simplified construction in every part thereof, including a float-contact means that eliminates the smearing of the drawing while smoothly moving the rule body, and a rule body whose edges can be easily reversed if the edge of the rule body is worn out or broken during usages, thus, bringing a longer life to the parallel rule.

Also, the clamping gripper body cover permits the easy assembly and replacement of parts between the gripper body cover and gripper body base, and the end body bases and end body covers ensures the correct positioning of the pulley and thin steel wire and thus prevents the wire from being disengaged. All these features reflect the simple construction which is a unique feature of the invention.

(3) Stable positioning of steel wire

An intermediate post installed between pulleys, in combination with end body cover protrusions, keeps the pulley always in correct position and the groove made in the pulley holds the steel wire in position, are additional features of this invention.

To summarize the above, this invention involves such features as the quick installation of the steel wire, simple repair work, stable positioning, smooth movement, and many other features, not offered by conventional designs.

What is claimed is:

1. A parallel rule, comprising:

(a) a rule body;

(b) a long rectangular gripper body base, affixed to the rule body and having a width smaller than the width of the rule body, the gripper body base including longitudinal sides having grooves integrally formed in each side thereof, and openings extending through the rule body and the gripper body base;

(c) a rectangular gripper body cover having a length substantially equal to the length of the gripper body base, the cover having protrusions along each longitudinal side and adapted to be securely received into the grooves integrally formed in the gripper body base;

(d) two end body bases, one attached to each end of said gripper body base.

(e) two end body covers;

(f) four pulleys, two of which are rotatably mounted on each of the two end body bases, the pulleys being held in position under the two end body covers;

(g) a plurality of float-contact means installed in the openings in the rule body and the gripper body base and held in position under the gripper body cover, the float-contact means being secured in their respective openings in the rule body and the gripper body base, each float-contact means including:

(1) a spring to urge the float-contact means toward the opening in the rule body and the gripper body base;

(2) a molding consisting of (i) a spring retainer to hold said spring in a position to urge said molding toward said opening;

(ii) a flange with a diameter, larger than the diameter of the respective opening in the rule body and gripper body base; and (iii) two ruler posts such that the posts and the space therebetween are smaller than the diameter of the respective opening in the rule body and gripper body base;

(3) a floating roller installed in the space between the roller posts.

2. The parallel rule of claim 1, wherein the plurality of float-contact means consists of six of the float-contact means.

3. A parallel rule, comprising:

(a) a base having a straight edge;

(b) a cover including first means adapted to matingly engage corresponding means in the base to couple the cover thereto; and (c) a plurality of float-contact means installed on the base and held in position under the gripper body cover, the float-contact means being secured in respective openings formed in the base each float-contact means including:

(1) a spring to urge the float-contact means through said opening;

(2) a floating roller; and (3) a molding having (i) a flange to prevent said molding from being urged out through said opening, and (ii) a means for receiving said floating roller.

4. The parallel rule of claim 3, wherein the base includes:

a rule body; and a gripper body base attached to the rule body.

5. The parallel rule of claim 3, wherein:

the gripper body base is an elongated rectangular body with a width smaller than that of the rule body and is provided with grooves integrally formed in its longitudinal sides; and the first means on the cover are protrusions for matingly engaging the grooves integrally formed in the gripper body.

6. A parallel rule, comprising:

(a) a rule body;

(b) a gripper body base, affixed to the rule body;

(c) a cover including first means adapted to matingly engage corresponding means in the gripper body base to couple the cover thereto; and (d) a plurality of float-contact means installed on the gripper body base and held in position under the gripper body cover, the float-contact means being secured in respective openings formed in the rule body and the gripper body base, each float-contact means including:

(1) a means for applying force between the gripper body cover and the float-contact means;

(2) a roller; and (3) a molding having (i) a retainer to retain and to position said means for applying force; and (ii) a flange to prevent said molding from being urged out through said opening; and (iii) a means for receiving said roller.

7. The parallel rule of claim 6, wherein the plurality of float-contact means consists of six of the float-contact means.

8. A parallel rule, comprising:

(a) a rule body;

(b) a gripper body base, affixed to the rule body;

(c) a cover including first means adapted to matingly engage corresponding means in the gripper body base to couple the cover thereto; and (d) a plurality of float-contact means installed on the gripper body and held in position under the cover, the float-contact means being secured in respective openings formed in the rule body and the gripper body base, each float-contact means including:

(1) a spring;

(2) a molding consisting of i) a spring retainer to hold said spring in a position to urge said molding toward said opening;

ii) a flange with a diameter larger than the diameter of the respective opening in the rule body and the gripper body base; and iii) two roller posts such that the posts and the space therebetween the two roller posts is smaller than the diameter of the respective opening in the rule body and the gripper body base;

(3) a floating roller installed in the space between the roller posts.

9. The parallel rule of claim 8, wherein the plurality of float-contact means consists of six of the float-contact means.

* * * * *